United States Patent [19]

Miller

[11] Patent Number: 5,067,680

[45] Date of Patent: Nov. 26, 1991

[54] SHAMPOO BOTTLE SUPPORT DEVICE

[76] Inventor: Wayne C. Miller, 5745 Whitman Ter., Pennsauken, N.J. 08109

[21] Appl. No.: 648,029

[22] Filed: Jan. 30, 1991

[51] Int. Cl.[5] ..... A47K 1/08

[52] U.S. Cl. ..... 248/311.3; 222/181; 222/206

[58] Field of Search ..... 248/311.3, 314, 206.2, 248/206.4; 222/180, 181, 183, 185, 174, 206, 212, 632; 215/100 R; 211/88

[56] References Cited

U.S. PATENT DOCUMENTS

| | | | |
|---|---|---|---|
| 863,260 | 8/1907 | Butterfield | 222/206 UX |
| 1,553,113 | 9/1925 | Rutt | 222/181 UX |
| 1,560,184 | 11/1925 | McLean | 222/181 |
| 1,581,074 | 4/1926 | MacFarland | 222/181 |
| 2,093,942 | 9/1937 | Stuff | 222/181 |
| 2,196,356 | 4/1940 | De Sipio et al. . | |
| 2,689,066 | 9/1954 | Budnik | 248/311.3 X |
| 3,926,347 | 12/1975 | Low | 222/185 |
| 4,324,348 | 4/1982 | Johnson | 222/183 X |
| 4,326,648 | 4/1982 | Kieber | 248/311.3 X |
| 4,969,580 | 11/1990 | Ezzat | 248/311.3 X |

FOREIGN PATENT DOCUMENTS

| | | | |
|---|---|---|---|
| 461185 | 8/1913 | France | 222/206 |

*Primary Examiner*—J. Franklin Foss

[57] ABSTRACT

A device for supporting a bottle of shampoo in an inverted position on a shower wall. With the bottle in an inverted position the process of dispensing liquid from the bottle is relatively quick, especially when the bottle is in a near empty condition (when there is a lower liquid head in the bottle).

2 Claims, 1 Drawing Sheet

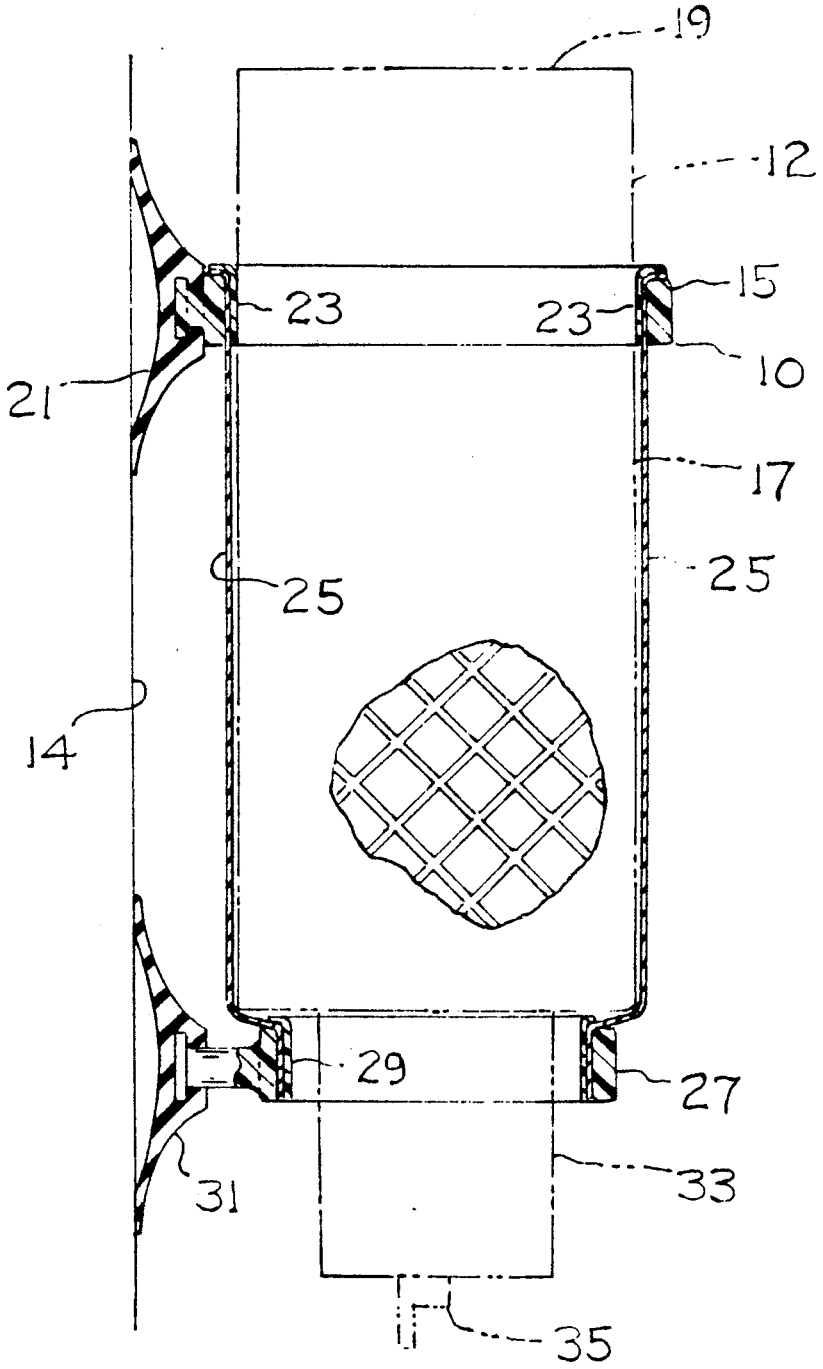
19
12
15
23
23
10
21
17
25
25
14
29
27
31
33
35

SHAMPOO BOTTLE SUPPORT DEVICE

BACKGROUND AND SUMMARY OF THE INVENTION

This invention relates to a device for suspending a squeeze bottle containing hair shampoo in an upside down (inverted) position on a shower wall.

Hair shampoo is conventionally sold in squeeze bottles. The liquid is dispensed from the bottle by turning it upside down and applying a squeeze pressure on the side walls of the bottle. The bottle side walls are flexed inwardly toward the bottle axis to reduce the bottle volume; air within the bottle is slightly compressed to force liquid shampoo downwardly out of the bottle through a manual valve carried on the neck (cap) area of the bottle.

When the bottle is in a near-empty condition it becomes somewhat more difficult to dispense liquid shampoo from the bottle. A given inward flexure of the bottle side walls produces a somewhat smaller increase in the internal air pressure because the air volume decrease is smaller in a relative sense. Also, the liquid gravitational head is less due to the lesser liquid volume.

When the bottle is in a near-empty condition the liquid dispensing action becomes primarily a gravitational flow of the liquid. The manual squeeze pressure on the bottle side walls becomes relatively less effective as a dispensing force. The semi-viscous nature of the liquid tends to impede the flow when the bottle is initially inverted. Some time is required before the liquid gravitates downwardly within the bottle to reach the discharge valve. The person using the bottle of shampoo experiences a certain degree of exasperation. Ocassionally the person will throw the bottle in the waste basket while there is still enough shampoo in the bottle to produce one or more hair washing actions.

The present invention relates to a device for suspending a bottle of shampoo in an inverted position on a shower wall. The bottle is permanently supported in an inverted position (while in the device); this is advantageous primarily when the bottle is in a near-empty condition, since the liquid is in direct contact with the discharge valve. As the person opens the discharge valve the liquid is enabled to immediately gravitate through the open valve into the person's hand for application to the hair, thereby shortening the time required to dispense the liquid.

An additional advantage of the bottle support device is that more liquid can drain down along the internal surface of the bottle side wall to collect at the neck area of the bottle; i.e. the liquid can drain over time, prior to the liquid dispensing operation. As a result a greater percentage of the bottle contents can be used.

THE DRAWINGS

The single figure is a sectional view taken through a device embodying the invention. A conventional shampoo bottle is shown in dashed lines.

DESCRIPTION OF A PREFERRED EMBODIMENT OF THE INVENTION

The drawing shows a device 10 for suspending a squeeze bottle 12 containing hair shampoo (or hair conditioner) in an inverted position on a shower wall 14. The bottle-suspension device comprises an upper annular ring 15 adapted to encircle the side wall 17 of the bottle at a point spaced downwardly from the bottle end wall 19. If the bottle were in its normal upright position wall 19 would be the bottom of the wall of the bottle.

A suction cup 21 extends laterally from upper ring 15 for suction engagement on the shower wall. Also, an annular clamp band 23 is insertable into ring 15 to exert a clamp force on the upper end portion of a flexible tubular sock 25. The sock is preferably formed of an open mesh net material so that the shampoo bottle is visible through the holes in the sock wall. The person can thus see the liquid level through the translucent side wall of the bottle without removing the bottle from the bottle-suspension device. Also, the net material is readily flexible, such that that person can easily exert a flexing squeeze force on the bottle side wall without removing the bottle from device 10.

A second annular ring 27 is attached to a lower end portion of sock 25. A second clamp band 29 is inserted into the sock to attached the sock to ring 27. A second suction cup 31 extends laterally from ring 27 for suction engagement on shower wall 14.

With the device 10 attached to the shower wall 14, via suction cups 21 and 31, a conventional bottle of shampoo can be inserted into sock 25 to assume an inverted (upside down) position. Lower ring 27 has a smaller diameter than upper ring 15, such that the bottle cannot slip downwardly through the rings. The bottle includes a neck area (or cap) 33 containing a manual valve 35. The valve can be operated to an open position without removing the bottle from sock 25. With the valve in an open condition a manual squeeze force can be applied to the side of the bottle to assist (or achieve) a liquid dispenser action.

Device 10 is constructed so that it can remain attached to the shower wall between periods of use. The bottle of shampoo (or hair conditioner) is left in the sock so that liquid is enabled to drain down the inner side surface of the bottle, so as to form a liquid pool in the vicinity of neck area 33.

I claim:

1. A device for suspending a squeeze bottle of liquid hair shampoo upside down on a shower wall: said device comprising an upper annular circular ring adapted to encircle a squeeze bottle; a first single suction cup extending laterally from said upper ring for suction engagement with a shower wall; a lower annular circular ring adapted to encircle the neck area of a squeeze bottle, said lower ring having a smaller diameter than said upper ring so that the circumscribed bottle cannot slip downwardly through the rings; a second single suction cup extending laterally from said lower ring for suction engagement with a shower wall; and a flexible open-ended tubular sock extending between the two rings to encircle a squeeze bottle; the flexibility of the sock being such that a person can apply a squeeze pressure through the sock and onto the bottle, thereby causing liquid shampoo to be discharged downwardly out of the bottle; said flexible open-ended sock being formed of an open mesh fabric material such that the shampoo bottle is visible through the sock.

2. The device of claim 1, and further comprising a separate means for connecting the sock to each annular ring; each connecting means comprising an annular clamp band extending within the sock in the plane of the associated ring for clamping the sock material against the inner surface of said associated ring.

* * * * *